US005450733A

United States Patent [19]

Kim et al.

[11] Patent Number: 5,450,733

[45] Date of Patent: Sep. 19, 1995

[54] INPUT ENERGY SAVING DEVICE FOR LOW FREQUENCY VIBRATION TYPE WASHING MACHINE

[75] Inventors: Jung C. Kim, Seoul; Dong Y. Oh; Gyu S. Choe, both of Kyungki; Kyung S. Hong, Inchon-Jikhalsi; Kyung H. Kim, Seoul; Joo Hwan Lee, Kyungki; Ha I. Lee, Kyungki; Kyeong B. Park, Seoul; Dong S. Gil, Seoul; Oh H. Kwon, Seoul; Byoung H. Kwon, Busan-Jikhalsi, all of Rep. of Korea

[73] Assignee: Goldstar Co., Ltd., Seoul, Rep. of Korea

[21] Appl. No.: 253,742

[22] Filed: Jun. 3, 1994

[30] Foreign Application Priority Data

Jun. 5, 1993 [KR] Rep. of Korea ..... 9743/1993

[51] Int. Cl.[6] ..... D06F 17/00

[52] U.S. Cl. ..... 68/3 SS; 68/131; 134/184; 134/196; 366/113

[58] Field of Search ..... 68/3 SS, 133, 131; 134/104, 196, 197; 366/113, 108, 127, 267, 268

[56] References Cited

U.S. PATENT DOCUMENTS

| | | | |
|---|---|---|---|
| 2,203,479 | 6/1940 | Witwer et al. | 134/196 |
| 2,776,558 | 1/1957 | Vang | 68/3 SS |
| 2,932,962 | 4/1960 | Stickel | 68/3 SS |

FOREIGN PATENT DOCUMENTS

| | | | |
|---|---|---|---|
| 1078560 | 5/1954 | France | 68/3 SS |
| 845790 | 6/1952 | Germany | 68/3 SS |
| 184546 | 1/1956 | Germany | 68/3 SS |
| 324247 | 10/1957 | Switzerland | 68/3 SS |
| 848504 | 7/1981 | U.S.S.R. | 68/3 SS |

*Primary Examiner*—Frankie L. Stinson
*Attorney, Agent, or Firm*—Finnegan, Henderson, Farabow, Garrett & Dunner

[57] ABSTRACT

An input energy saving device for a low frequency vibration type washing machine. The device lets the resonance frequency of the washing tub and the input frequency of the oscillating disc be equal to each other during generation of resonance phenomena in the multi-phase washing medium for clothes washing, thus to save the input energy required in generation of the resonance phenomena. The device comprises a washing tub receiving multi-phase washing medium therein and an oscillating disc provided in the washing tub for generation of resonance phenomena in the washing medium. A flexible elastic body is placed between the disc and the inner bottom of the washing tub for letting the input frequency of the disc means and the resonance frequency of the washing tub be equal to each other. An actuator is coupled to the disc through a shaft so as to drive the disc means.

4 Claims, 3 Drawing Sheets

INPUT ENERGY SAVING DEVICE FOR LOW FREQUENCY VIBRATION TYPE WASHING MACHINE

BACKGROUND OF THE INVENTION

1. Field of the Invention

The present invention relates in general to automatic washing machines using low frequency vibration in clothes washing and, more particularly, to an improved structure in such washing machines for saving the input energy during generation of resonance phenomena in the multi-phase washing medium for clothes washing.

2. Description of the Prior Art

In a typical pulsator type washing machine, a pulsator is provided in the washing tub. In clothes washing using the above pulsator type washing machine, the pulsator is alternately rotated in opposed directions by forward and reversed rotational forces of a drive motor under the control of a motor clutch, thus to generate a heart type current or a scroll type current in the multi-phase washing medium in the washing tub. Here, the multi-phase washing medium consists of water, detergent and air. In the above clothes washing, the pulsator type washing machine achieves a mechanical washing effect by bending, stretching and rubbing the clothes using the shearing force of the washing medium. This mechanical washing effect cooperates with a chemical washing effect caused by the detergent in the washing medium, thus to achieve the desired washing effect.

However, the above pulsator type washing machine has the following problems.

First, the typical pulsator type washing machine is apt to cause twisting and entangling of the clothes in the washing tub because of agitation caused by opposed directional rotations of the pulsator. In this regard, the washing machine may cause both damage of clothes and deterioration of the washing effect.

Second, the washing machine is reduced in the detergent solubility of the current and often causes the washed clothes to be stuck with detergent remnants. In this regard, the washing machine should waste large amount of water and lengthen the washing time. Furthermore, the detergent remnants sticking to the washed clothes have a bad effect to the skin.

In order to overcome the above problems of the typical pulsator type washing machine, there has been proposed a low frequency vibration type washing machine using a low frequency vibration in the clothes washing. In clothes washing using the typical low frequency vibration type washing machine, a low frequency oscillating disc placed in the washing tub generates a specified low frequency vibration which causes the resonance phenomena in the multi-phase washing medium in the washing tub. The level of low frequency is specified in accordance with shape of the washing tub, shape of the oscillating disc and mixing ratio of the multi-phase washing medium.

In the above washing machine, the desired mechanical washing effect is achieved by the micro air bulbs generated by cavitation of the oscillating disc or nonlinear vibration. Both the cavitation or the nonlinear vibration is generated in the multi-phase medium at the same time of generation of the resonance phenomena. The mechanical washing effect caused by the cavitation or the nonlinear vibration cooperates with a chemical washing effect caused by the detergent in the washing medium, thus to achieve the desired washing effect.

With reference to FIG. 1, there is shown a typical automatic washing machine using the low frequency vibration. The washing machine generally comprises a washing tub 1*a*, receiving multi-phase washing medium therein, and a low frequency oscillating disc 4*a* causing the resonance phenomena in the washing medium. The oscillating disc 4*a* is placed in the washing tub 1*a* and coupled to an actuator 2 through a shaft 3. The shaft 3 transmits the drive force of the actuator 2 to the disc 4*a* so as to drive this disc 4*a*. The actuator 2, which is mounted on the outer bottom of the washing tub 1*a*, is applied with an amplitude signal and a frequency signal from a signal oscillator 7. A signal amplifier 8 is placed on a line between the actuator 2 and the signal oscillator 7 for amplifying and varying the signals generated by the signal oscillator 7.

There is provided a gap between the inner bottom of the washing tub 1*a* and the disc 4*a* for allowing the disc 4*a* to vertically vibrate. A lid 9 is provided in the opening of the washing tub 1 for covering the opening.

In operation of the above washing machine, the low frequency oscillating disc 4*a* is driven by the actuator 2 in response to signals applied from the signal oscillator 7 to the actuator 2 through the signal amplifier 8. This disc 4*a* thus oscillates in order to cause the resonance phenomena in the multi-phase washing medium in the washing tub 1*a*. Here, the desired mechanical washing effect is achieved by the micro air bulbs generated by cavitation of the oscillating disc or nonlinear vibration, which cavitation and nonlinear vibration are generated in the multi-phase medium at the same time of generation of the resonance phenomena. The above mechanical washing effect cooperates with the chemical washing effect caused by the detergent in the washing medium, thus to achieve the desired washing effect as described above.

In the above clothes washing using the low frequency vibration, the signal oscillator 7 makes the oscillating disc 4 oscillating in an oscillation frequency band of 20–250 Hz, an amplitude band of 2–25 mm and a rotational amplitude band of 2°–10°. Here, the signal amplifier 8 amplifies current signals or voltage signals which are to be applied from the signal oscillator to the actuator 2.

It has been noted that the above low frequency vibration type washing machine has the following problems.

First, in the above washing machine, the desired resonance phenomena of the washing medium can not generated by only the stiffness of the fluid in the washing tub. In this regard, the washing machine can not achieve the desired washing effect with minimum input energy.

Second, the clothes may be jammed in the gap between the oscillating disc 4*a* and the inner bottom of the washing tub 1*a*. When the clothes are jammed in the gap as described above, the clothes may be damaged and the washing effect of the washing machine will be deteriorated.

SUMMARY OF THE INVENTION

It is, therefore, an object of the present invention to provide an input energy saving device for a low frequency vibration type washing machine in which the aforementioned problems can be overcome and which lets the resonance frequency of the washing tub and the input frequency of the oscillating disc be equal to each other during generation of resonance phenomena in the multi-phase washing medium for clothes washing, thus to save the input energy required in generation of the resonance phenomena.

In order to accomplish the above object, an input energy saving device for a low frequency vibration type washing machine in accordance with the present invention comprises: a washing tub receiving multi-phase washing medium therein, the multi-phase washing medium consisting of water, detergent and air; disc means provided in the washing tub for generation of resonance phenomena in the washing medium; stiffness improving means for letting an input frequency of the disc means and a resonance frequency of the washing tub be equal to each other, the stiffness improving means being placed between the disc means and the inner bottom of the washing tub; and an actuator coupled to the disc means through a shaft so as to drive the disc means.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
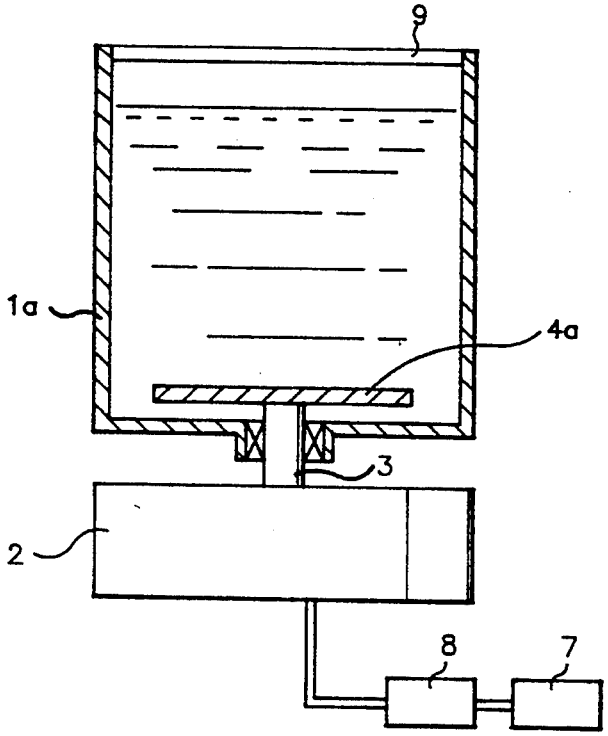
FIG. 1 PRIOR ART
FIG. 1 is a sectional view of a typical washing machine using a low frequency vibration in its washing operation.

In the following description, those elements common to both the embodiments of this invention and the prior art embodiment of FIG. 1 will carry the same reference numerals.

Figure 2:
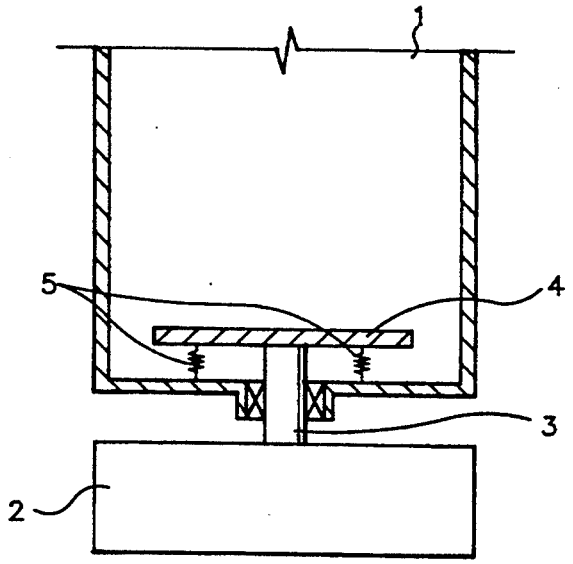
FIG. 2 is a sectional view of an input energy saving device for a low frequency vibration type washing machine in accordance with a primary embodiment of the present invention.

With reference to FIG. 2, there is shown an input energy saving device for a low frequency vibration type washing machine in accordance with a primary embodiment of the present invention. The input energy saving device comprises a washing tub 1 for receiving therein multi-phase washing medium, which medium consists of water, detergent and air. An oscillating disc 4 is provided in the washing tub 1 for generation of resonance phenomena in the washing medium. The oscillating disc 4 is placed in the washing tub 1 and coupled to an actuator 2 through a shaft 3. The shaft 3 transmits the drive force of the actuator 2 to the disc 4 so as to drive this disc 4. The above input energy saving device further includes stiffness improving means for letting the input frequency of the disc means and the resonance frequency of the washing tub be equal to each other. The stiffness improving means is provided between the oscillating disc 4 and the inner bottom of the washing tub 1. In the primary embodiment, the stiffness improving means comprises a plurality of coil springs 5 which are connected to the lower surface of the disc 4 and the inner bottom of the washing tub 1.

In the conventional manner, there is provided an appropriate gap between the inner bottom of the washing tub 1 and the disc 4 for allowing the disc 4 to vertically vibrate.

When letting mass, displacement, angular velocity and inertia force of the disc 4 be M, X, $\omega$ and I respectively and letting stiffness coefficient and damping coefficient of water of the washing medium be Kw and Cw respectively and letting the input energy be f while not regarding the stiffness coefficient of the stiffness improving means or of the coil springs 5, the equation of motion of the low frequency vibration type washing machine will be represented by the following equation (1)

$$f=(M+I)X''+CwX'+KwX \tag{1}$$

The above equation (1) is a harmonic function so that it will be converted into the following equation (2)

$$f\cdot e^{jwt}=-[(M+I)\omega^2-Kw]\cdot e^{jwt}+j\omega Cw\cdot e^{jwt} \tag{2}$$

As represented in the above equation (2), the input energy "f" will be minimized when the square of angular velocity of the disc 4 is equal to Kw/(M+I), that is, when $\omega^2=Kw/(M+I)$. However, since the inertia force I and the stiffness coefficient Kw of water are a function $\{I(\omega), Kw(\omega)\}$ of the angular velocity $\omega$ of the disc 4, the relation between the input frequency $\omega r$ of the disc 4 and the resonance frequency $\omega f$ of the washing tub 1 will be represented by the following equation $$\omega^2 f>\omega^2 r, \omega^2 r=Kw(\omega)/[M+I(\omega)]$$

Therefore, it will be understood that the desired resonance phenomena can not achieved using only the stiffness coefficient Kw of water but achieved when the stiffness coefficient of the springs 5 is added.

When the stiffness coefficient K of the springs 5 is added to the above equation (1), the equation (1) will be represented by the following equation (3)

$$f=(M+I)X''+CwX'+(Kw+K)X \tag{3}$$

Thus, when the springs 5 having the stiffness coefficient K, which coefficient K can cause $\omega^2=Kw/(M+I)$ and let the relation between the input frequency $\omega r$ of the disc 4 and the resonance frequency $\omega f$ of the washing tub 1 be represented by $\omega^2 f=\omega^2 r^3, \omega^2 r=(Kw(\omega)+K)/[M+I(\omega)]$, are provided between the disc 4 and the inner bottom of the washing tub 1, the input energy required in generation of the resonance phenomena in the washing medium will be minimized. Otherwise stated, the input energy is saved in the above case.

Figure 3:
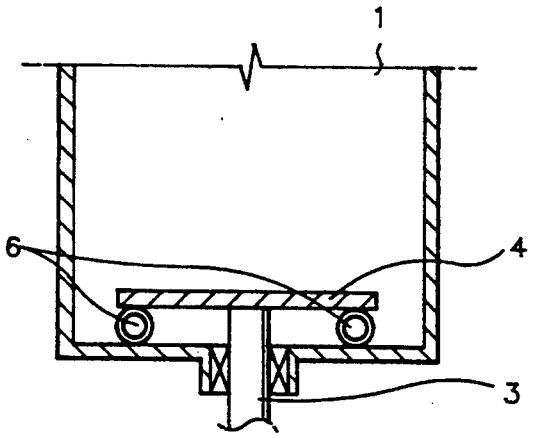
FIG. 3 is a sectional view of an input energy saving device in accordance with a second embodiment of the present invention.

Turning to FIG. 3, there is shown an input energy saving device in accordance with a second embodiment of the present invention. In this second embodiment, the stiffness improving means comprises an annular rubber tube 6 which is charged with fluid and placed between the disc 4 and the inner bottom of the washing tub 1. Of course, the annular rubber tube 6 may be substituted with another tube made of a soft material other than the rubber.

Figure 4:
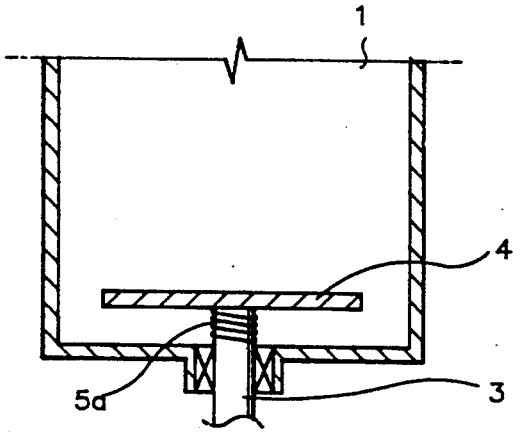
FIG. 4 is a view corresponding to FIG. 3, but showing a third embodiment of the present invention.

FIG. 4 shows an input energy saving device in accordance with a third embodiment of the present invention. In this third embodiment, the stiffness improving means comprises a coil spring 5*a* fitted over the shaft 3 between the disc 4 and the inner bottom of the washing tub 1.

As described above, an input energy saving device for a low frequency vibration type washing machine in accordance with the present invention includes a predetermined stiffness of elastic means or stiffness improving means placed between the oscillating disc and the inner bottom of the washing tub, thus to let the resonance frequencies of the washing tub and the input frequency of the oscillating disc be equal to each other during generation of resonance phenomena in the multi-phase washing medium for clothes washing. The device thus minimizes the input energy required in generation of the resonance phenomena and remarkably saves the input energy.

With the elastic means placed between the oscillating disc and the inner bottom of the washing tub, the clothes are prevented from jamming in the gap between the disc and the washing tub inner bottom so that the input energy saving device can remarkably improves both the washing effect and the reliability of the washing machine.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An input energy saving device for a low frequency vibration type washing machine comprising:

a washing tub receiving multi-phase washing medium therein, said multi-phase washing medium including water, detergent and air;

disc means provided in said washing tub so as to generate resonance phenomena in the washing medium;

stiffness improving means for letting an input frequency ($\omega r$) of said disc means and a resonance frequency ($\omega f$) of said washing tub be equal to each other, said stiffness improving means being placed between the disc means and the inner bottom of the washing tub and having a stiffness coefficient(K) obtained from a motion equation, said motion equation being:

$$\omega^2 f = \omega^2 r = (Kw(\omega) + K)/[M + I(\omega)]$$

where Kw is a stiffness coefficient of water, M is a mass coefficient of said disc means and I is an inertia force of said disc means; and an actuator coupled to the disc means through a shaft so as to drive the disc means.

2. The input energy saving device according to claim 1, wherein said stiffness improving means includes a rubber tube.

3. The input energy saving device according to claim 2, wherein said rubber tube is charged with fluid.

4. The input energy saving device according to claim 1, wherein said stiffness improving means is fitted over said shaft between the disc means and the inner bottom of the washing tub.

* * * * *

UNITED STATES PATENT AND TRADEMARK OFFICE

CERTIFICATE OF CORRECTION

PATENT NO. : 5,450,733

DATED : September 19, 1995

INVENTOR(S) : Jung Chul KIM et al

It is certified that error appears in the above-indentified patent and that said Letters Patent is hereby corrected as shown below:

Abstract, Title page, Line 7, "clothes washing" should read --washing clothes--;

Line 8, delete "the" (first occurrence) and insert --the-- before "generation";

Line 15, delete "means";

Line 18, delete "means".

Signed and Sealed this

Third Day of September, 1996

*Attest:*

Bruce Lehman

BRUCE LEHMAN

*Attesting Officer*

*Commissioner of Patents and Trademarks*